US009989272B2

(12) United States Patent
Yumoto et al.

(10) Patent No.: US 9,989,272 B2
(45) Date of Patent: Jun. 5, 2018

(54) AIR CONDITIONER

(71) Applicant: DAIKIN INDUSTRIES, LTD., Osaka-shi, Osaka (JP)

(72) Inventors: Yoshiaki Yumoto, Osaka (JP); Tsuyoshi Yokomizo, Osaka (JP); Shunichi Uenaka, Osaka (JP); Mario Hayashi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 531 days.

(21) Appl. No.: 14/375,312

(22) PCT Filed: Feb. 8, 2013

(86) PCT No.: PCT/JP2013/000713
§ 371 (c)(1),
(2) Date: Jul. 29, 2014

(87) PCT Pub. No.: WO2013/118513
PCT Pub. Date: Aug. 15, 2013

(65) Prior Publication Data

US 2015/0013362 A1 Jan. 15, 2015

(30) Foreign Application Priority Data

Feb. 10, 2012 (JP) ..... 2012-026866

(51) Int. Cl.
*F24F 11/34* (2018.01)
*F24F 11/00* (2018.01)

(52) U.S. Cl.
CPC ... *F24F 11/0034* (2013.01); *F24F 2011/0064* (2013.01)

(58) Field of Classification Search
None
See application file for complete search history.

(56) References Cited

U.S. PATENT DOCUMENTS 6,980,079 B1 * 12/2005 Shintani ..... H04L 12/2803 340/3.1
2010/0070089 A1 * 3/2010 Harrod ..... F24F 11/0086 700/277

FOREIGN PATENT DOCUMENTS

JP 5-203218 A 8/1993
JP 2004-150731 A 5/2004
(Continued)

OTHER PUBLICATIONS

International Search Report for PCT/JP2013/000713 dated May 7, 2013.

(Continued)

*Primary Examiner* — Mohammad Ali
*Assistant Examiner* — Saad M Kabir
(74) *Attorney, Agent, or Firm* — Birch, Stewart, Kolasch & Birch, LLP

(57) ABSTRACT

In an air conditioner, one of a linkage mode or a non-linkage mode is selected by a user as a control mode of an external device. In the air conditioner, when the linkage mode is selected, on/off control of the external device by using a human detection sensor is permitted during operation, whereas on/off control of the external device by using the human detection sensor is inhibited during suspension of operation. In the air conditioner, when the non-linkage mode is selected, on/off control of the external device by using the human detection sensor is always permitted, irrespective of whether the air conditioner is in operation or not.

4 Claims, 7 Drawing Sheets

(56) References Cited

FOREIGN PATENT DOCUMENTS

| | | | |
|---|---|---|---|
| JP | 2005-183319 | A | 7/2005 |
| JP | 2010-164231 | A | 7/2010 |

OTHER PUBLICATIONS

Written Opinion of the International Searching Authority for PCT/JP2013/000713 dated May 7, 2013.

* cited by examiner

FIG.8

| | PRESENCE OF HUMAN | EXTERNAL DEVICE |
|---|---|---|
| IN OPERATION (OPERATING STATE) | YES | ON |
| | NO | OFF |
| SUSPENDED (SUSPENDED STATE) | YES | OFF |
| | NO | OFF |

FIG.9

| | PRESENCE OF HUMAN | EXTERNAL DEVICE |
|---|---|---|
| IN OPERATION (OPERATING STATE) | YES | ON |
| | NO | OFF |
| SUSPENDED (SUSPENDED STATE) | YES | ON |
| | NO | OFF |

AIR CONDITIONER

TECHNICAL FIELD

The present invention relates to air conditioners, and particularly to enhancement of convenience of air conditioners for users.

BACKGROUND ART

In typical air conditioners, indoor units are provided with human detection sensors. For example, in an air conditioner described in Patent Document 1, the location of a human is detected by a human detection sensor, and based on this detection result, an air blow from an indoor unit into a room is controlled to directions in which there is no human. In this manner, the degree of comfort in the room can be increased with reduced feeling of drafts.

CITATION LIST

Patent Document

[Patent Document 1] Japanese Unexamined Patent Publication No. 2004-150731

SUMMARY OF THE INVENTION

Technical Problem

It is conceivable to use the above-described human detection sensor in order to control an external device such as a lighting unit. In the case of controlling a lighting unit, the lighting unit is turned on upon detection of the presence (an entry into a room) of a human, and is turned off upon detection of the absence (an exit from the room) of a human so that the convenience for a user can be enhanced.

However, since the human detection sensor is located in the indoor unit, the sensor is stopped in conjunction with stopping of operation of the air conditioner. Consequently, an external device cannot be controlled by using the human detection sensor while operation of the air conditioner is stopped.

It is therefore an object of the present invention to control an external device by using a human detection sensor in an indoor unit not only during operation of an air conditioner but also during suspension of the air conditioner and, thereby, to enhance convenience for a user.

Solution to the Problem

In a first aspect of the present invention, an air conditioner includes: an indoor unit (20); an outdoor unit (10); and a human detection sensor (26) that is located in the indoor unit (20) and detects presence of a human, or a person, in a room. The indoor unit (20) includes a controller (28) that controls an external device based on a detection result of the human detection sensor (26). The air conditioner further includes a setup section (32) that enables a user to select one of a linkage mode in which the controller (28) permits control of the external device based on the detection result of the human detection sensor (26) while the air conditioner is in operation and the controller (28) inhibits control of the external device based on the detection result of the human detection sensor (26) while the air conditioner is stopped or a non-linkage mode in which the controller (28) permits control of the external device based on the detection result of the human detection sensor (26) irrespective of whether the air conditioner is in operation or not.

In the first aspect, when the non-linkage mode is selected, the controller (28) always permits control of the external device based on the detection result of the human detection sensor (26). Thus, even when operation of the air conditioner (1) is stopped, the external device is controlled by using the human detection sensor (26).

In a second aspect of the present invention, in the air conditioner of the first aspect, the air conditioner is configured to transition to a standby state in which electric power is supplied to the human detection sensor (26) and the controller (28) and no electric power is supplied to the outdoor unit (10) while the air conditioner is stopped, and in the non-linkage mode, the controller (28) permits control of the external device based on the detection result of the human detection sensor (26) when the air conditioner is in the standby state.

In the second aspect, the air conditioner transitions to the standby state while operation is stopped. In the standby state, the external device can be controlled by using the human detection sensor (26) and the controller (28), and supply of electric power to the outdoor unit (10) is shut off. Thus, power consumption (standby power) of the whole air conditioner (1) can be reduced.

Advantages of the Invention

With the technique of the present invention, on/off control of the external device is enabled during operation. A user can select the non-linkage mode in which on/off control of the external device is permitted during suspension of operation as well as during operation, in addition to the linkage mode in which on/off control of the external device is inhibited while operation is stopped. In this manner, the external device can be controlled by using the human detection sensor (26) during suspension of operation, thereby enhancing convenience for the user.

In the second aspect, the air conditioner is configured to transition to the standby state in which electric power is supplied to the human detection sensor (26) and the controller (28) and no electric power is supplied to the outdoor unit (10) while operation is stopped. Thus, even in a case where the non-linkage mode is selected and the external device is controlled while operation is stopped, power consumption (standby power) of the whole air conditioner (1) during suspension of operation can be reduced.

BRIEF DESCRIPTION OF THE DRAWINGS

FIG. 8 shows on and off states of an external device in a linkage mode.

FIG. 9 shows on and off states of the external device in a non-linkage mode.

DESCRIPTION OF EMBODIMENTS

An embodiment of the present invention will be described with reference to the drawings. Note that the following embodiment of the preferred embodiment is merely illustrative in nature, and is not intended to limit the scope, applications, and use of the invention.

Embodiment

<Overall Configuration>

Figure 1:
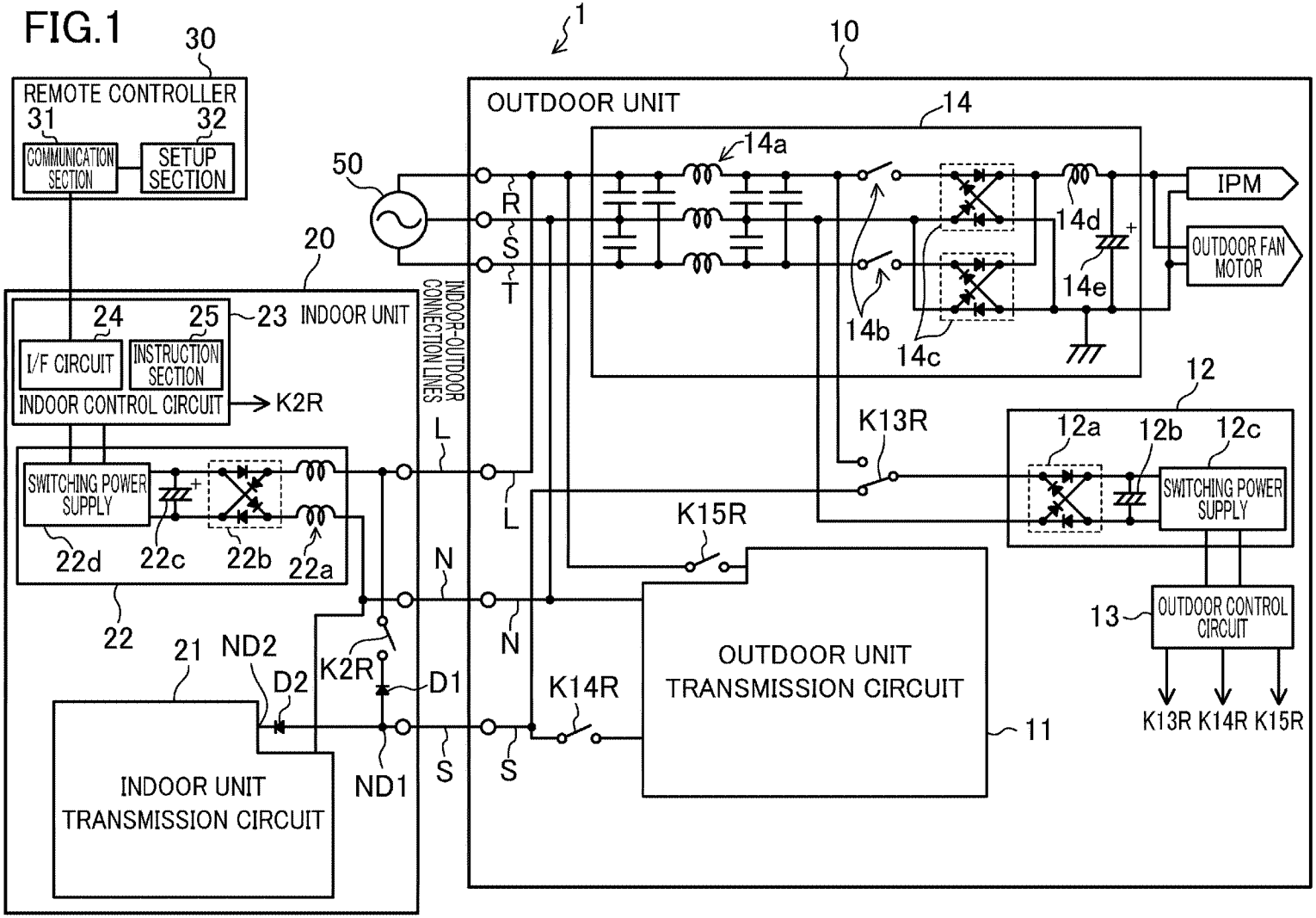
FIG. 1 is a block diagram (in a suspended state) illustrating an electrical system of an air conditioner according to an embodiment.

FIG. 1 is a block diagram illustrating an electrical system of an air conditioner (1) according to an embodiment of the present invention. As illustrated in FIG. 1, the air conditioner (1) includes an outdoor unit (10), an indoor unit (20), and a remote controller (30). Although not shown, the outdoor unit (10) includes an electric compressor, an outdoor heat exchanger, an outdoor fan, and an expansion valve, for example. The indoor unit (20) includes an indoor heat exchanger and an indoor fan, for example. In the air conditioner (1), these components constitute a refrigerant circuit (not shown) that performs a refrigeration cycle.

In the air conditioner (1), the outdoor unit (10) receives an alternating current (AC) (a three-phase AC at 200 V in this example) from a commercial AC power supply (50) and uses the AC as electric power for circuits and the electric compressor in the outdoor unit (10). The outdoor unit (10) also supplies part of the three-phase AC corresponding to two phases to the indoor unit (20). Signal communication is performed between the outdoor unit (10) and the indoor unit (20) in order to control the outdoor unit (10) from the indoor unit (20). For this purpose, the air conditioner (1) includes, between the outdoor unit (10) and the indoor unit (20), three lines (indoor-outdoor communication lines): a power line (L) for transmitting AC power from the AC power supply (50), a signal line (S) for transmitting the signal, and a common line (N) to be shared by the transmission of the AC power and transmission of the signal.

<Outdoor Unit (10)>

The outdoor unit (10), serving as an electrical system, includes a first outdoor power supply circuit (14), a second outdoor power supply circuit (12), an outdoor unit transmission circuit (11), an outdoor control circuit (13), and relays (K13R, K14R, K15R).

—First Outdoor Power Supply Circuit (14)—

The first outdoor power supply circuit (14) converts a three-phase AC received from the AC power supply (50) to a direct current (DC), and supplies the DC to a so-called intelligent power module (hereinafter referred to as an IPM) and an outdoor fan motor. The IPM converts the received DC to an AC having a predetermined frequency and a predetermined voltage, and supplies the AC to the motor of the electric compressor. The first outdoor power supply circuit (14) includes a noise filter (14*a*), two main relays (14*b*), two diode bridge circuits (14*c*), a reactor (14*d*), and a smoothing capacitor (14*e*).

The noise filter (14*a*) includes a capacitor and a coil. The two main relays (14*b*) are respectively provided on the supply lines of an R-phase and a T-phase of the three-phase AC. The main relays (14*b*) are so-called A-contact relays. One of the two diode bridge circuits (14*c*) receives the R-phase and an S-phase of the three-phase AC, the other receives the S-phase and the T-phase of the three-phase AC, and each of the received phases of the AC is subjected to full-wave rectification. Outputs of the diode bridge circuits (14*c*) are input to the smoothing capacitor (14*e*) through the reactor (14*d*), and smoothed by the smoothing capacitor (14*e*). The DC smoothed by the smoothing capacitor (14*e*) is supplied to the IPM and the outdoor fan motor.

—Second Outdoor Power Supply Circuit (12)—

The second outdoor power supply circuit (12) converts the two phases of the R-phase and S-phase of the three-phase AC to a DC (5 V in this example), and supplies the DC to the outdoor control circuit (13). The second outdoor power supply circuit (12) includes a diode bridge circuit (12*a*), a smoothing capacitor (12*b*), and a switching power supply (12*c*). One of the inputs of the diode bridge circuit (12*a*) is connected to the relay (K13R), which will be specifically described later, and the other input of the diode bridge circuit (12*a*) is connected to the S-phase of the three-phase AC. An output of the diode bridge circuit (12*a*) is smoothed by the smoothing capacitor (12*b*), and then input to the switching power supply (12*c*). The switching power supply (12*c*) converts an input DC to a predetermined voltage (5 V), and outputs the voltage to the outdoor control circuit (13).

—Outdoor Unit Transmission Circuit (11)—

The outdoor unit transmission circuit (11) performs signal communication with the indoor unit transmission circuit (21). In this communication, based on a potential difference between the signal line (S) and the common line (N), communication of a binary digital signal is performed. An end of a communication circuit (not shown) in the outdoor unit transmission circuit (11) is connected to the common line (N), and the other end of the communication circuit is connected to the signal line (S) through the relay (K14R).

—Relay (K13R)—

The relay (K13R) is a relay for switching an AC supply path to the second outdoor power supply circuit (12). The relay (K13R) is a so-called C-contact relay. Switching of the relay (K13R) (whether current is supplied to the coil or not) is controlled by the outdoor control circuit (13).

A movable contact of the relay (K13R) is connected to the input of the diode bridge circuit (12*a*). The normally closed contact is connected to the signal line (S), and the normally opened contact is connected to the R-phase of the three-phase AC. That is, when no current is supplied to the coil of the relay (K13R), the normally closed contact and the movable contact are connected to each other, and one of the inputs of the diode bridge circuit (12*a*) is connected to the signal line (S). Once electric power has been supplied to the coil of the relay (K13R), the movable contact and the normally opened contact are connected to each other, and an AC is input to the diode bridge circuit (12*a*) of the second outdoor power supply circuit (12).

—Relay (K14R)—

The relay (K14R) is a relay for connecting or disconnecting the signal line (S) and the outdoor unit transmission circuit (11). The relay (K14R) is a so-called A-contact relay. On/off operation of the relay (K14R) is controlled by the outdoor control circuit (13).

—Relay (K15R)—

The relay (K15R) is a relay for switching the supply of electric power to the outdoor unit transmission circuit (11) between on and off. The relay (K15R) is a so-called A-contact relay. On/off operation of the relay (K15R) is controlled by the outdoor control circuit (13).

—Outdoor Control Circuit (13)—

The outdoor control circuit (13) includes a microcomputer and a memory (not shown) storing a program for operating the microcomputer. In the outdoor control circuit (13), the outdoor unit transmission circuit (11), for example, controls the electric compressor and other components in response to a signal received from the indoor unit transmission circuit (21), and also controls start operation of the outdoor unit (10). When the air conditioner (1) is in a suspended state, power supply to the outdoor control circuit (13) is shut off, and operation thereof is stopped.

<Indoor Unit (20)>

The indoor unit (20), serving as an electrical system, includes an indoor power supply circuit (22), an indoor unit transmission circuit (21), an indoor control circuit (23), a relay (K2R), a first diode (D1), and a second diode (D2).

—Indoor Power Supply Circuit (22)—

The indoor power supply circuit (22) converts an AC supplied from the AC power supply (50) through the power line (L) and the common line (N) to a DC (a DC at 5 V in this example), and supplies the DC to the indoor control circuit (23). The indoor power supply circuit (22) includes a noise filter (22*a*), a diode bridge circuit (22*b*), a smoothing capacitor (22*c*), and a switching power supply (22*d*). The noise filter (22*a*) includes two coils. The diode bridge circuit (22*b*) performs full-wave rectification on an AC input from the power line (L) and the common line (N) through the noise filter (22*a*). The smoothing capacitor (22*c*) is, for example, an electrolytic capacitor, and smooths an output of the diode bridge circuit (22*b*). The switching power supply (22*d*) converts the DC smoothed by the smoothing capacitor (22*c*) to a predetermined voltage (5 V), and inputs the predetermined voltage to the indoor control circuit (23).

—Indoor Unit Transmission Circuit (21)—

As described above, the indoor unit transmission circuit (21) performs signal communication with the outdoor unit transmission circuit (11). In this communication, communication of a digital signal is performed based on the potential difference between the signal line (S) and the common line (N). Thus, an end of a communication circuit of the indoor unit transmission circuit (21) is connected to the signal line (S) through the second diode (D2), and the other end of the communication circuit is connected to the common line (N).

—Relay (K2R) and First and Second diodes (D1, D2)—

The relay (K2R) is a so-called A-contact relay. The relay (K2R) and the first diode (D1) are provided in the indoor unit (20), and are serially connected to each other between the power line (L) and the signal line (S). The relay (K2R) serves as a switch for connecting or disconnecting the power line (L) and the signal line (S). On/off operation of the relay (K2R) is controlled by the indoor control circuit (23). The first diode (D1) inhibits an AC flowing into the indoor unit transmission circuit (21). The second diode (D2) inhibits an AC flowing out of the indoor unit transmission circuit (21).

—Indoor Control Circuit (23)—

The indoor control circuit (23) includes a microcomputer and a memory (not shown) storing a program for operating the microcomputer, and receives electric power from the indoor power supply circuit (22) for control of an operating state of the air conditioner (1). The indoor control circuit (23) includes an I/F circuit (24) and an instruction section (25).

—I/F Circuit (24)—

The I/F circuit (24) is connected to the remote controller (30), and transmits and receives a signal to/from the remote controller (30).

Figure 2:
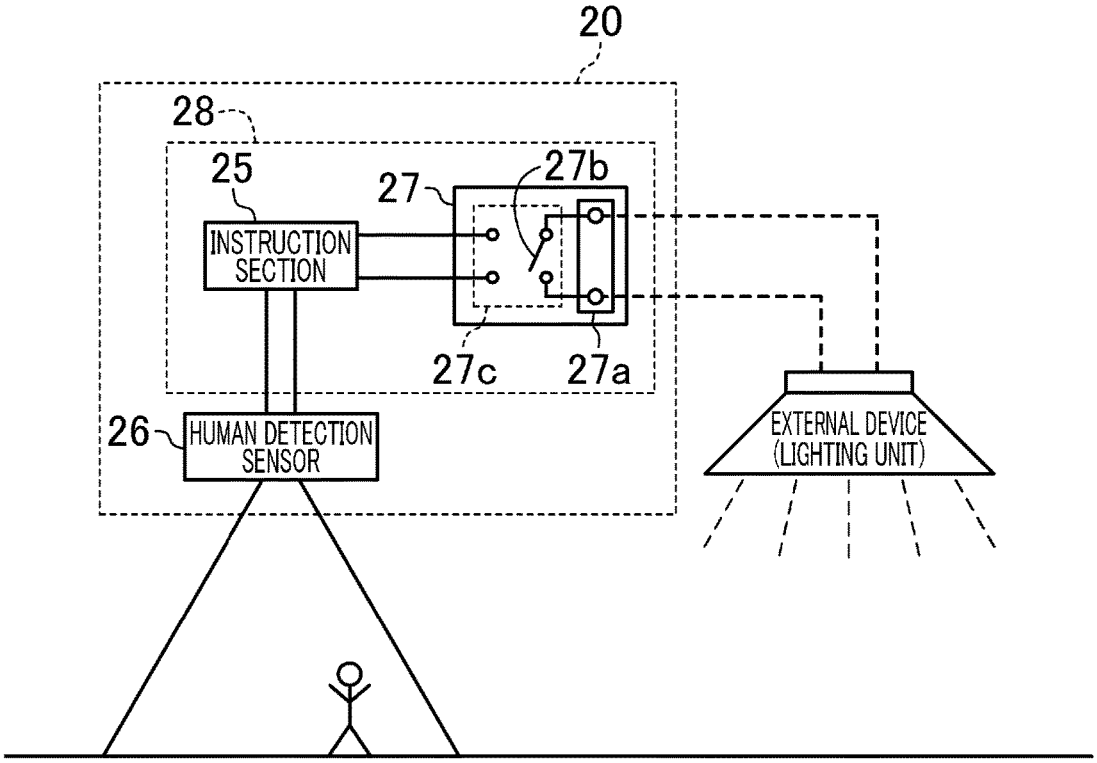
FIG. 2 is a block diagram illustrating the periphery of a controller for controlling an external device of the embodiment.

As illustrated in FIG. 2, the instruction section (25) is connected to the human detection sensor (26) and the external device controller (27).

—Human Detection Sensor (26)—

The human detection sensor (26) is an infrared ray sensor, and detects the presence of a human in a room by using an energy variation of radiated infrared rays. The human detection sensor (26) is placed in the indoor unit (20), and is configured to perform detection in a conical region expanding from the human detection sensor (26) downward at a predetermined angle.

—Instruction Section (25)—

The instruction section (25) receives a detection signal of the human detection sensor (26), determines whether a human is in a room or not, and outputs a result of the determination to the external device controller (27). Specifically, the instruction section (25) outputs a presence signal when detecting the presence of a human, and outputs an absence signal when detecting the absence of a human. In addition, the instruction section (25) outputs an operation signal to the external device controller (27) in an operating state, and outputs a suspension signal to an external device controller (27) in a suspended state.

—External Device Controller (27)—

The external device controller (27) receives signals (i.e., the presence signal, the absence signal, the operation signal, and the suspension signal) from the instruction section (25), and thereby, turning on or off the external device. The external device controller (27) includes: a connection terminal (27*a*) connectable to an external device (e.g., a lighting unit in this example); and a switching section (27*c*) including a relay (27*b*) connected to the connection terminal (27*a*). The external device controller (27) receives signals (i.e., the presence signal and the operation signal) for turning the external device on, and thereby, turns on the relay (27*b*) of the switching section (27*c*). Consequently, the external device is turned on. The external device controller (27) receives the signals (i.e., the absence signal and the suspension signal) for turning the external device off, and thereby, turns off the relay (27*b*) of the switching section (27*c*). Consequently, the external device is turned off. The external device controller (27) and the instruction section (25) constitute a controller (28) that controls the external device based on a detection result of the human detection sensor (26). The external device controller (27) may be provided on a board on which the indoor control circuit (23) is located, or may be provided on a board different from a board on which the indoor control circuit (23) is located, such that the external device controller (27) can be connected to an external device.

<Remote Controller (30)>

As illustrated in FIG. 1, the remote controller (30) is a so-called wired remote controller, and is connected to the indoor unit (20) through a transmission line. The remote controller (30) includes a communication section (31) and a setup section (32).

—Communication Section (31)—

The communication section (31) is connected to the transmission line, and transmits and receives signals with the I/F circuit (24).

—Setup Section (32)—

In the setup section (32), the control mode of the external device is selected by a user. The control mode of the external device includes a linkage mode and a non-linkage mode. In the linkage mode, the external device is turned on when a human is in the room and is turned off when no human is in the room during operation (i.e., in an operating state), whereas the external device is turned off irrespective of whether a human is in the room or not during suspension of operation (i.e., in a suspended state). In the non-linkage mode, the external device is always on when a human is in the room, and is turned off when no human is in the room, in both operation and suspension of operation.

<Operation of Air Conditioner (1)>

Figure 3:
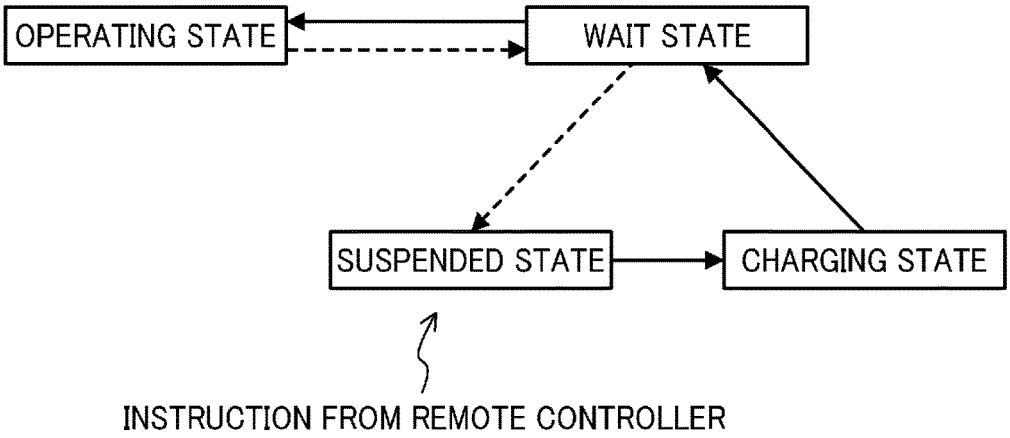
FIG. 3 is a state transition diagram of the air conditioner of the embodiment.

FIG. 3 is a state transition diagram of the air conditioner (1). The air conditioner (1) transitions among four states: a "suspended state," a "charging state," a "wait state," and an "operating state," which will be described later.

(1) Suspended State

The suspended state is a standby state of the present invention, specifically a state in which electric power is supplied to the indoor unit (20) and no electric power is supplied to the outdoor unit (10).

For example, in the suspended state of this embodiment, power consumption of the whole air conditioner (1) is the minimum. Specifically, in the suspended state of this embodiment, the outdoor unit (10) receives and supplies electric power to the indoor unit (20), but no electric power is supplied to, for example, the circuits and the electric compressor in the outdoor unit (10). In this manner, in the suspended state, power supply to the circuits in the outdoor unit (10) is shut off, thereby reducing standby power consumption.

On the other hand, standby power consumption of the indoor unit (20) is the minimum, and in this embodiment, part of the human detection sensor (26), the instruction section (25), the external device controller (27), and the remote controller (30) responsible for signal reception from the remote controller (30) receives electric power from the indoor power supply circuit (22) and operates.

Standby power consumption of the remote controller (30) is also the minimum, and can accept predetermined indications of operation by a user. The degrees of power consumption (standby power consumption) of the indoor unit (20) and the remote controller (30) are not limited to those described herein.

(2) Charging State

For the outdoor unit (10), the charging state refers to a state from start of charging of the second outdoor power supply circuit (12) to start of signal transmission between the outdoor unit transmission circuit (11) and the indoor unit transmission circuit (21).

The degrees of power consumption of the indoor unit (20) and the remote controller (30) in the charging state are similar to those in the suspended state.

(3) Wait State

The wait state refers to a state in which the air conditioner is not in the charging state when operation is started, and a state to which the air conditioner transitions from an operating state (which will be described later) when operation is stopped. In both cases, the outdoor unit (10) is ready for, i.e., can promptly transition to, the operating state (which will be described later) through the wait state. In the wait state, the outdoor unit transmission circuit (11) and the outdoor control circuit (13) can also operate. In particular, the wait state at an operation stop (i.e., the wait state transitioned from the operating state) is provided in order to uniformize the refrigerant pressure in the electric compressor and to be used for scheduled operation in which an operation start and an operation stop are repeatedly performed.

The degrees of power consumption of the indoor unit (20) and the remote controller (30) are similar to those in the charging state.

(4) Operating State

The operating state refers to a state in which the first outdoor power supply circuit (14) supplies electric power to the IPM and the fan motor so that the electric compressor and the outdoor fan are operable or in operation.

The degree of power consumption of the remote controller (30) in the operating state is similar to that in the charging state. On the other hand, the degree of power consumption of the indoor unit (20) in the operating state is higher than those in the other states because the indoor fan and other components are in the operating states.

—Operation Start—

In an operation start of the air conditioner (1), the state transitions from the suspended state to the charging state, the wait state, and the operating state in this order (as indicated by arrows of continuous lines in FIG. 3). Operation from the suspended state to the operating state will now be described.

<Electrical System in Suspended State>

First, a state of the electrical system in the suspended state will be described. FIG. 1 illustrates states of the relays in the suspended state.

In the outdoor unit (10), the main relays (14*b*) is off, and no power is supplied from the first outdoor power supply circuit (14) to any of the IPM and the outdoor fan motor. The relay (K14R) and the relay (K15R) are off. That is, connection of the outdoor unit transmission circuit (11) to the signal line (S) is broken, and supply of electric power is shut off. In the relay (K13R), the normally closed contact point and the movable contact are connected to each other. That is, one of the inputs of the diode bridge circuit (12*a*) of the second outdoor power supply circuit (12) is connected to the signal line (S). In this state, no current flows in the second outdoor power supply circuit (12), and no electric power is supplied to the outdoor control circuit (13), either. In this manner, supply of electric power to the outdoor unit (10) is shut off.

In the indoor unit (20), the relay (K2R) is off, and the signal line (S) and the power line (L) are not electrically connected to each other. In the indoor unit (20), the human detection sensor (26), the instruction section (25), the external device controller (27), and part of the indoor unit (20) responsible for signal reception from the remote controller (30) receive electric power from the indoor power supply circuit (22) and operates.

<Transition from Suspended State to Charging State>

Figure 4:
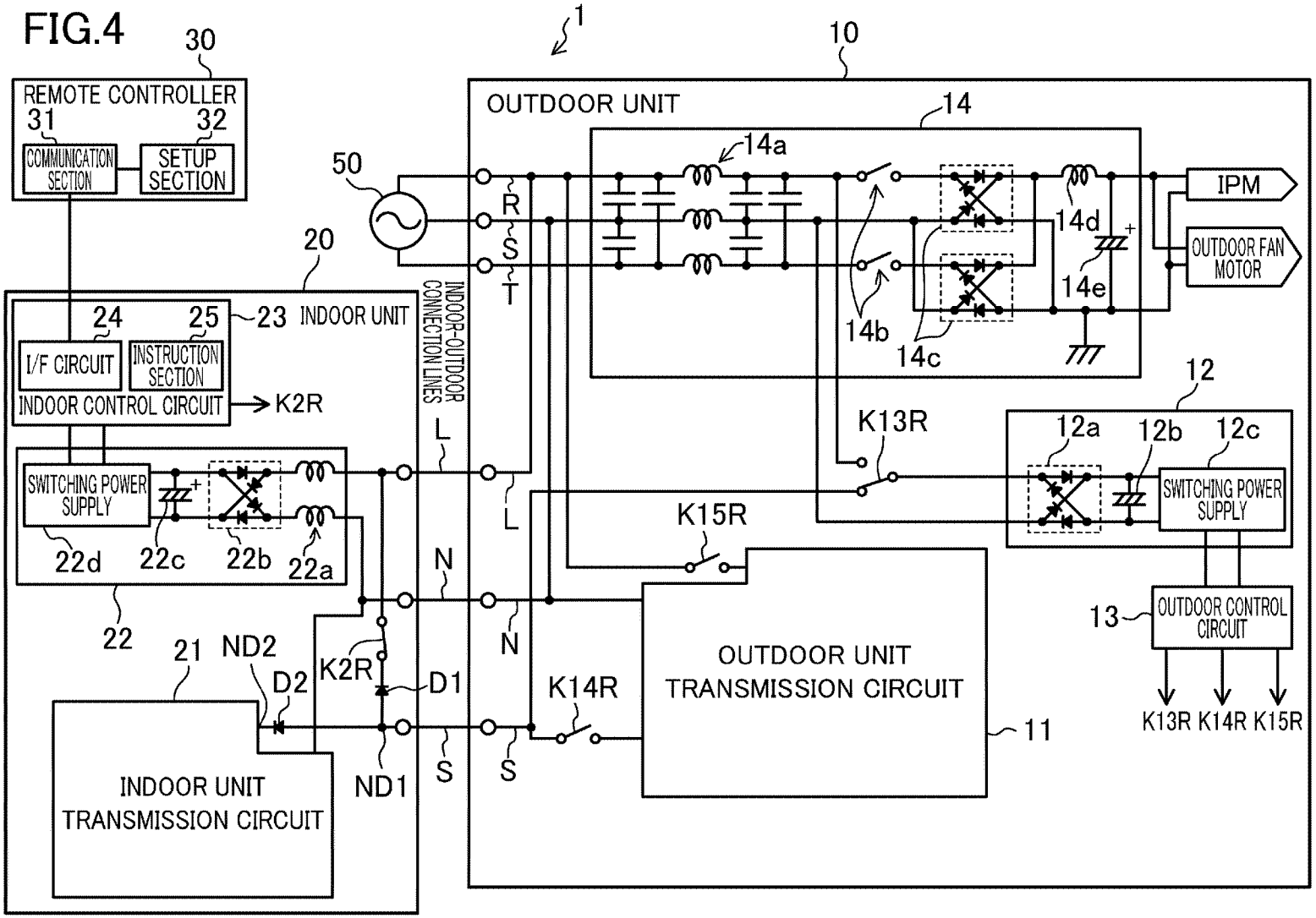
FIG. 4 illustrates states of relays when a circuit for charging a smoothing capacitor is formed.
Figure 5:
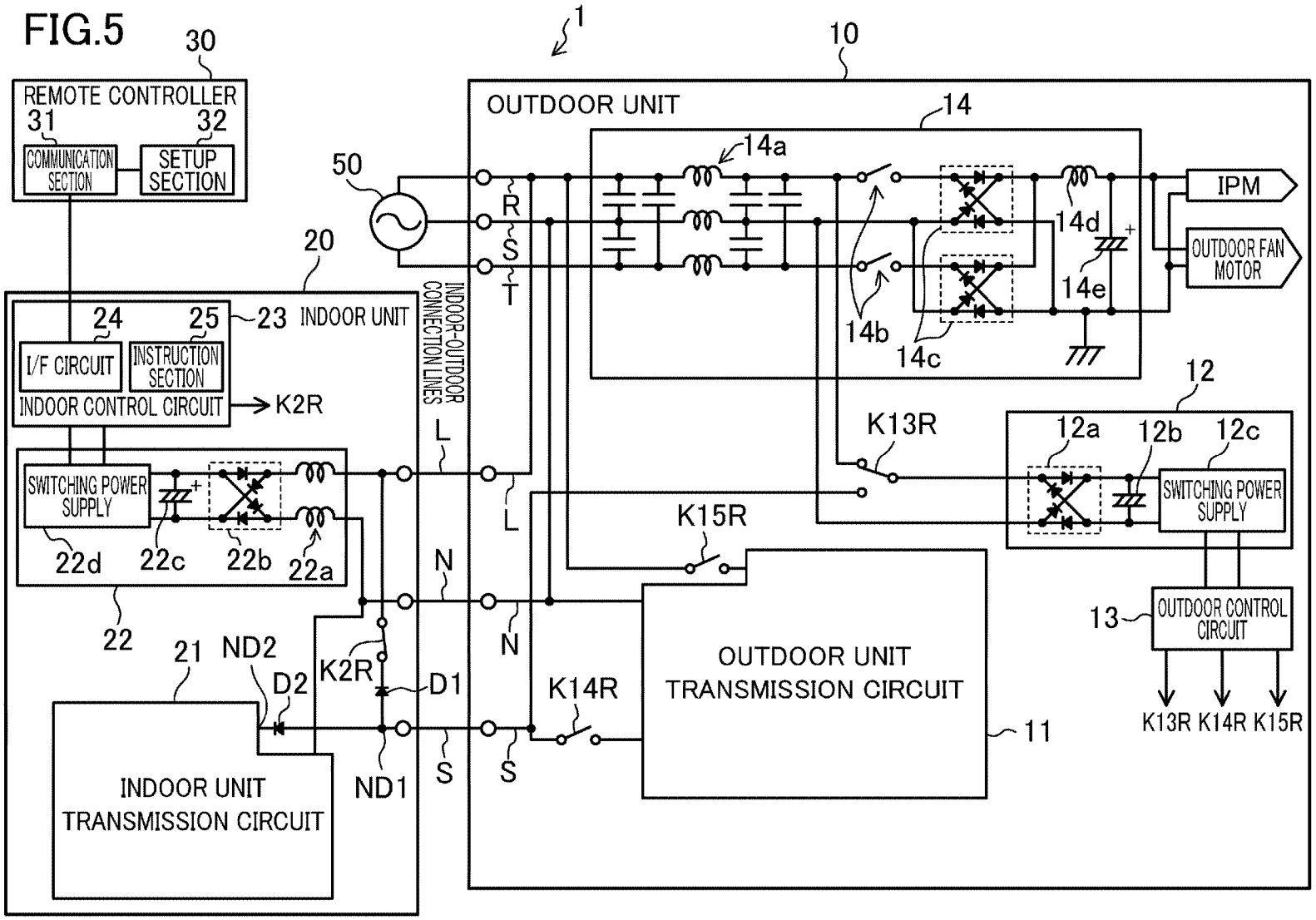
FIG. 5 illustrates states of the relays after transition to a charging state has been completed.

FIG. 4 illustrates states of the relays when a circuit for charging the smoothing capacitor (12*b*) of the second outdoor power supply circuit (12) is formed. FIG. 5 illustrates states of the relays after transition to the charging state has been completed.

when a user presses an operation button (not shown) of the remote controller (30), an operation start signal is transmitted from the communication section (31) to the indoor unit (20).

In the indoor unit (20), when the I/F circuit (24) receives the operation start signal, the indoor control circuit (23) turns the relay (K2R) on. Then, a path from the R-phase of the three-phase AC to the second outdoor power supply circuit (12) via the power line (L), the relay (K2R), the first diode (D1), the signal line (S), and the relay (K13R) is formed. In this manner, a circuit for charging the smoothing capacitor (12*b*) of the second outdoor power supply circuit (12) is formed (see FIG. 4).

In the outdoor unit (10), when the smoothing capacitor (12*b*) is charged and input of electric power to the switching power supply (12*c*) is stabilized so that the switching power supply (12*c*) is allowed to output a specific DC voltage (5V in this example), the outdoor control circuit (13) is started. The outdoor control circuit (13) that has been started causes a current to flow in the coil of the relay (K13R) so that the normally opened contact point and the movable contact are connected to each other. In this manner, one of the inputs of the diode bridge circuit (12*a*) is connected to the R-phase of the three-phase AC via a power transmission path in the outdoor unit (10). That is, the outdoor control circuit (13) is switched to a state in which electric power is supplied from the AC power supply (50) not passing through the signal line (S) (see FIG. 5). Then, transition from the suspended state to the charging state is completed.

<Transition from Charging State to Wait State>

Figure 6:
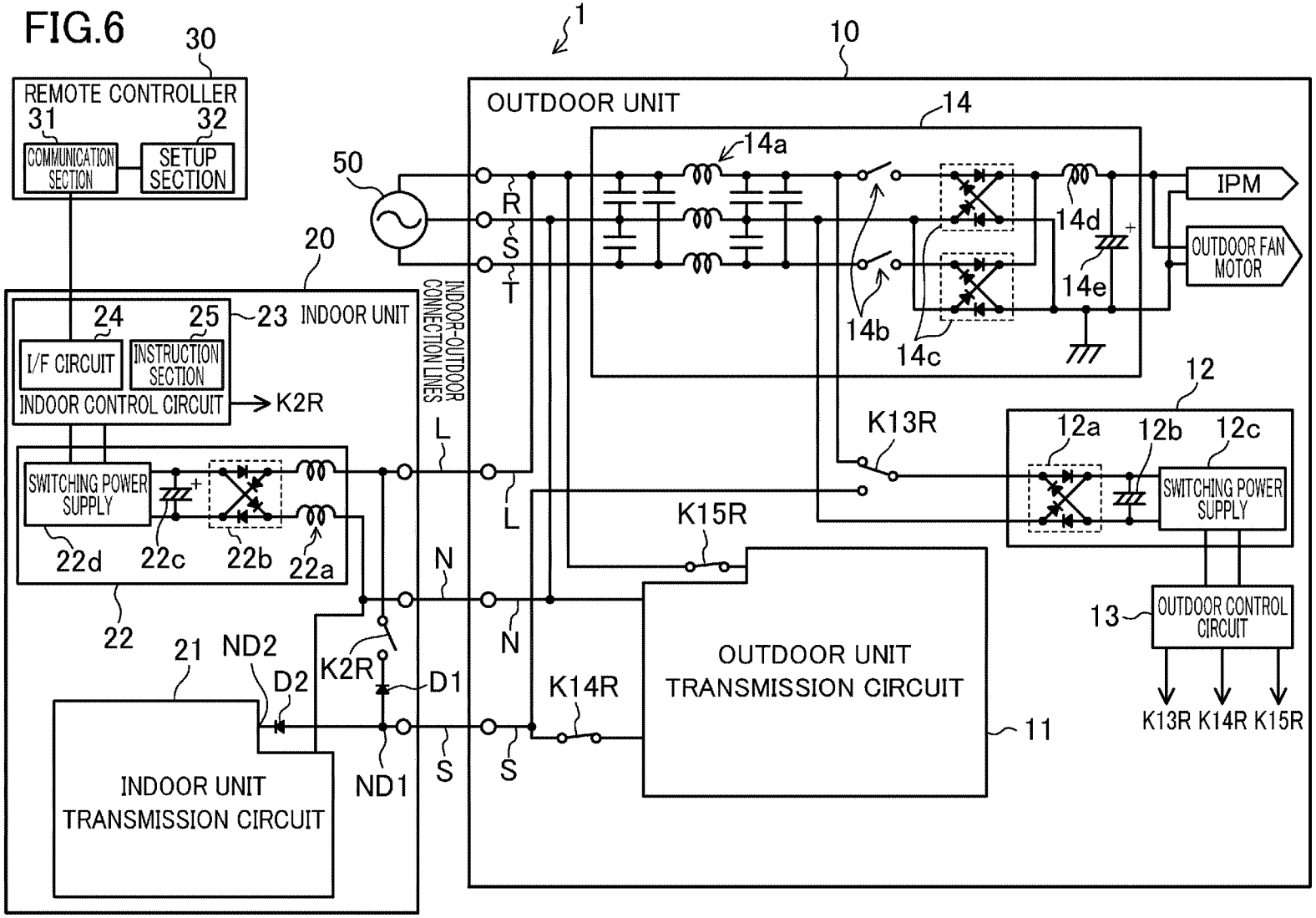
FIG. 6 illustrates states of the relays in a wait state.

FIG. 6 illustrates states of the relays when transition to the wait state is completed. In the indoor unit (20), after a lapse of a predetermined time (a time sufficient for startup of the outdoor control circuit (13)) from turning on of the relay (K2R), the relay (K2R) is turned off. In this manner, the signal line (S) can be used for signal transmission.

In the outdoor unit (10), after the relay (K2R) has been turned off, the outdoor control circuit (13) turns the relay (K15R) on so that electric power is supplied to the outdoor unit transmission circuit (11), and the outdoor control circuit (13) also turns the relay (K14R) on. In this manner, the communication circuit in the outdoor unit transmission circuit (11) is connected to the indoor unit transmission circuit (21) through the signal line (S) and the common line (N), and thus, becomes able to communicate with the indoor unit transmission circuit (21). Consequently, the air conditioner (1) transitions to a state (i.e., a wait state) in which the air conditioner (1) is ready for transition to the operating state promptly through the charging state.

<Transition from Wait State to Operating State>

Figure 7:
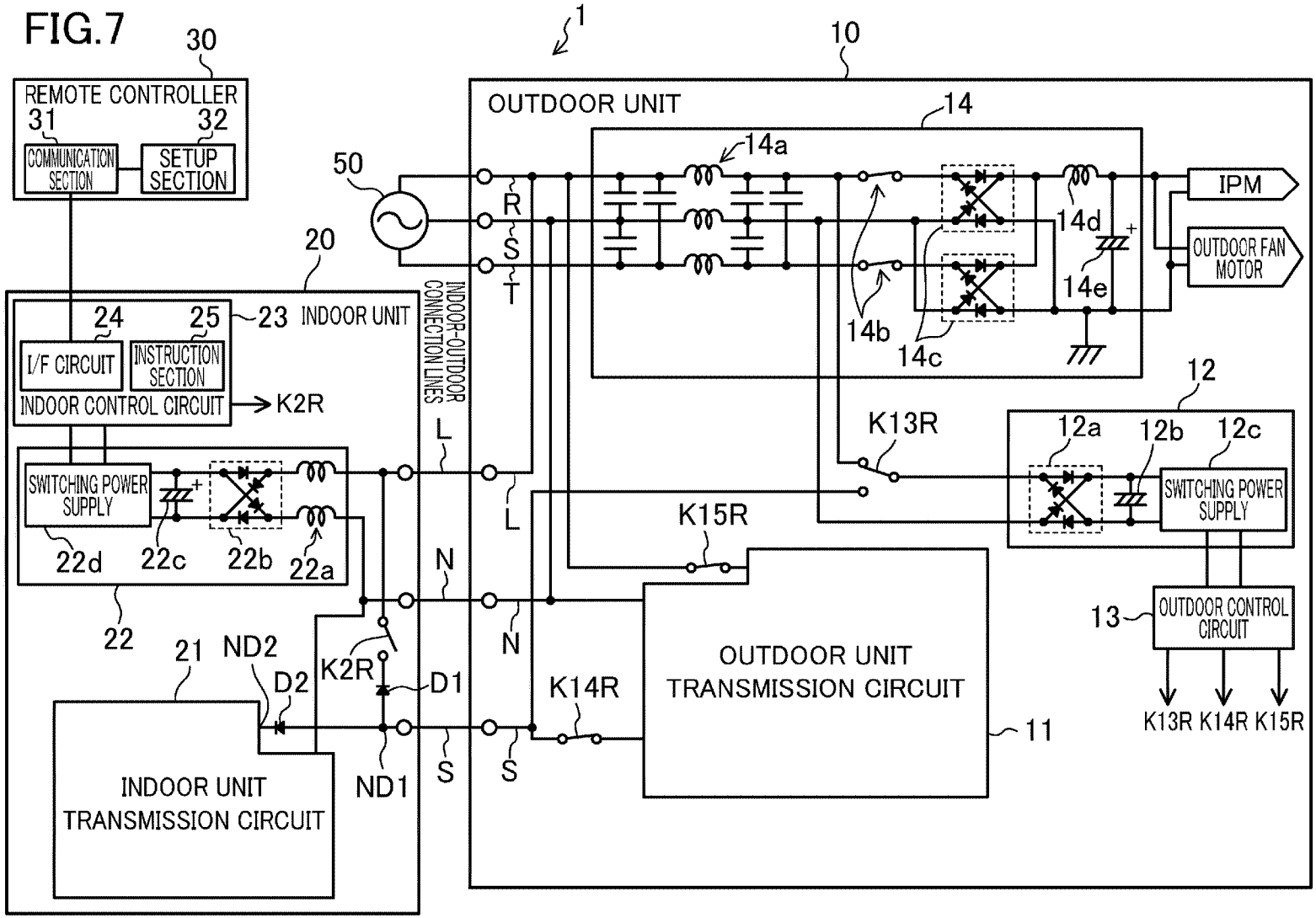
FIG. 7 illustrates states of the relays in an operating state.

FIG. 7 illustrates states of the relays in the operating state. In transition from the wait state to the operating state, the outdoor control circuit (13) turns the two main relays (14*b*) on. Then, the first outdoor power supply circuit (14) supplies electric power to the IPM and the outdoor fan motor, and the electric compressor and other components come to be in the operating state and performs, for example, cooling operation.

—Operation Stop—

In operation stop of the air conditioner (1), the state transitions from the operating state to the wait state and then to the suspended state (as indicated by arrows of dotted lines in FIG. 3). Operation from the operating state to the suspended state will now be described in order.

<Transition from Operating State to Wait State>

When a user presses an operation button of the remote controller (30) in the operating state, the remote controller (30) transmits an operation stop signal to the indoor unit (20), and then the indoor unit (20) transmits an operation stop signal to the outdoor unit (10).

In the outdoor unit (10), in response to the operation stop signal, the outdoor control circuit (13) turns the main relays (14*b*) of the first outdoor power supply circuit (14) off (see FIG. 6). Thus, electric power supply to the IPM and the outdoor fan motor is shut off, and the electric compressor and other components are stopped. In this manner, transition from the operating state to the wait state is completed.

<Transition from Wait State to Suspended State>

In the wait state, first, the remote controller (30) determines whether to transition to the suspended state or not depending on whether a predetermined time has elapsed or not. After a lapse of the predetermined time, the remote controller (30) determines that transition to the suspended state is allowed. Then, the remote controller (30) transmits a shut-off request signal to the indoor unit (20), and the indoor unit (20) transmits the shut-off request signal to the outdoor unit (10).

In the outdoor unit (10), when the outdoor unit transmission circuit (11) receives the shut-off request signal, the outdoor control circuit (13) turns the relay (K14R) and the relay (K15R) off. In addition, the outdoor control circuit (13) connects the normally closed contact point and the movable contact of the relay (K13R) to each other, and thus, supply of electric power to the second outdoor power supply circuit (12) is shut off (see FIG. 1). In this manner, transition to the suspended state is completed.

—Control of External Device—

In the air conditioner (1) of this embodiment, the control mode of the external device is set in the setup section (32) of the remote controller (30). The user selects one of the linkage mode or the non-linkage mode, and inputs the selected mode.

<Linkage Mode>

In the case of selecting the linkage mode, the instruction section (25) outputs an operation signal to the external device controller (27) in the operating state, and the instruction section (25) outputs a suspension signal to the external device controller (27) in the suspended state.

Specifically, when operation start of the air conditioner (1) is performed so that the state transitions to the operating state, the instruction section (25) outputs an operation signal to the external device controller (27). In the external device controller (27), the relay (27*b*) is turned on in response to the operation signal, and thereby, the external device is turned on.

On the other hand, when operation stop of the air conditioner (1) is performed so that the state transitions to the suspended state, the instruction section (25) outputs a suspension signal to the external device controller (27). In the external device controller (27), the relay (27*b*) is turned off in response to the suspension signal, and thereby, the external device is turned off.

Then, control of the external device by using the human detection sensor (26) will be described.

When the human detection sensor (26) detects the presence/absence of a human in the operating state, the detection signal is input to the instruction section (25). Based on this detection signal, the instruction section (25) determines whether a human is present or not. If it is determined that a human is present, the instruction section (25) outputs an operation signal to the external device controller (27). In the external device controller (27), in response to the operation signal, the relay (27*b*) is turned on, and thereby, the external device is kept on. On the other hand, if it is determined that a human is absent, operation stop is started, and the state then transitions to the suspended state. Once the transition to the suspended state has been completed, the instruction section (25) outputs a suspension signal to the external device controller (27). In the external device controller (27), in response to the suspension signal, the relay (27*b*) is turned off, and thereby, the external device is turned off. In this manner, in the operating state, control of the external device based on the detection result of the human detection sensor (26) is permitted.

On the other hand, when the human detection sensor (26) detects the presence/absence of a human in the suspended state, the detection signal is input to the instruction section (25). The instruction section (25), however, does not determine whether a human is present or not, based on the detection signal. Thus, control of the external device based on the detection result of the human detection sensor (26) is inhibited, and the external device is kept off.

In the foregoing manner, in the case of selecting the linkage mode, as illustrated in FIG. 8, the external device is turned on or off depending on the presence/absence of a human only during operation (i.e., only in the operating state), and the external device is always off during suspension of operation (i.e., in the suspended state).

<Non-Linkage Mode>

In the case of selecting the non-linkage mode, irrespective of the state of the air conditioner (1), the instruction section (25) outputs a presence signal to the external device controller (27) when a human is present, and the instruction section (25) outputs an absence signal to the external device controller (27) when a human is absent.

Specifically, when the human detection sensor (26) detects the presence/absence of a human, the detection signal is input to the instruction section (25). Based on the detection signal, the instruction section (25) determines whether a human is present or not. If it is determined that a human is present, the instruction section (25) outputs a presence signal to the external device controller (27). In the external device controller (27), the relay (27*b*) is turned on in response to the presence signal, and thereby, the external device is turned on. On the other hand, if it is determined that a human is absent, the instruction section (25) outputs an absence signal to the external device controller (27). In the external device controller (27), the relay (27*b*) is turned off in response to the absence signal, and thereby, the external device is turned off. Thus, control of the external device based on the detection result of the human detection sensor (26) is permitted.

In the foregoing manner, in the case of selecting the non-linkage mode, as illustrated in FIG. 9, irrespective of the state, i.e., during operation or suspension of operation, of the air conditioner (1), the external device is always turned on or off depending on whether a human is present or not.

Advantages of Embodiment

In this embodiment, the user can select the non-linkage mode in which on/off control of the external device is permitted during suspension of operation as well as during operation, in addition to the linkage mode in which on/off control of the external device is permitted during operation and on/off control of the external device is inhibited during suspension of operation. Thus, on/off control of the external device can be performed by using the human detection sensor (26) during suspension of operation, and as a result, convenience for the user can be enhanced.

In addition, in this embodiment, in operation stop, the state transitions to the suspended state in which supply of electric power to the outdoor unit (10) is shut off. Thus, even in the case of on/off control of the external device performed in suspension of operation by selecting the non-linkage mode, power consumption (standby power) of the whole air conditioner (1) in the suspension of operation can be reduced.

Further, in this embodiment, in the case of selecting the linkage mode, not only the external device but also the air conditioner (1) itself is stopped when a human moves out of the room, i.e., becomes absent in the room. Thus, a failure in stopping the air conditioner (1) when a human moves out of the room can be prevented.

Other Embodiments

In the above embodiment, the lighting unit is used as an external device. However, the external device is not limited to the lighting unit, and may be a humidifier, a ventilation device, an alarm, or a monitor, for example.

In addition, in the control of the above embodiment, the external device is turned on when a human is in the room, and is turned off when no human is in the room. In contrast, the external device may be turned off when a human is in the room, and turned off when no human is in the room.

In the above embodiment, on/off of the lighting unit serving as the external device is performed. However, control of the external device is not limited to on/off control, and may be, for example, adjustment of an output from the external device, such as changing of the luminance of the lighting unit.

INDUSTRIAL APPLICABILITY

As described above, the present invention is useful for air conditioners for conditioning air in the room.

DESCRIPTION OF REFERENCE CHARACTERS

1 air conditioner
10 outdoor unit
20 indoor unit
26 human detection sensor
28 controller
32 setup section

The invention claimed is:

1. An air conditioner comprising:
an indoor unit;
an outdoor unit; and
a human detection sensor that is located in the indoor unit and detects presence of a human in a room, wherein
the indoor unit includes a controller that controls an external device based on a detection result of the human detection sensor,
the air conditioner is configured to transition to a standby state in which electric power is supplied to the indoor unit and no electric power is supplied to the outdoor unit while the air conditioner is stopped,
in the standby state, electric power is supplied to the human detection sensor and the controller, and
the air conditioner further comprises a setup section that enables a user to select one of
a linkage mode in which the controller permits control of the external device based on the detection result of the human detection sensor while the air conditioner is in operation and the controller inhibits control of the external device based on the detection result of the human detection sensor while the air conditioner is stopped or in the standby state; and
a non-linkage mode in which the controller permits control of the external device based on the detection result of the human detection sensor irrespective of whether or not the air conditioner is in operation or in the standby state.

2. The air conditioner of claim 1, wherein the setup section is provided in a remote controller connected to the indoor unit.

3. The air conditioner of claim 1, wherein in the linkage mode
when the air conditioner is in an operating state, the controller turns on the external device when the human detection sensor detects the presence of the human in the room and turns off the external device when no human presence is detected; and
when the air conditioner is in a suspended state the controller turns off the external device irrespective of whether a human presence is detected or not.

4. The air conditioner of claim 1, wherein in the non-linkage mode the controller turns on the external device when the human detection sensor detects the presence of the human in the room and turns off the external device when no human presence is detected, irrespective of the state of the air conditioner.

* * * * *